US009932747B2

(12) United States Patent
Greenwald

(10) Patent No.: US 9,932,747 B2
(45) Date of Patent: Apr. 3, 2018

(54) SWIMMING POOL FILTRATIONS SYSTEM DEBRIS GUARD

(71) Applicant: Thomas Greenwald, Fairview, TX (US)

(72) Inventor: Thomas Greenwald, Fairview, TX (US)

( * ) Notice: Subject to any disclaimer, the term of this patent is extended or adjusted under 35 U.S.C. 154(b) by 0 days.

(21) Appl. No.: 15/068,191

(22) Filed: Mar. 11, 2016

(65) Prior Publication Data

US 2016/0251866 A1 Sep. 1, 2016

Related U.S. Application Data

(63) Continuation-in-part of application No. 14/977,563, filed on Dec. 21, 2015, now abandoned.

(60) Provisional application No. 62/095,186, filed on Dec. 22, 2014.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.19, 232
See application file for complete search history.

(56) References Cited

U.S. PATENT DOCUMENTS

| | | | | | |
|---|---|---|---|---|---|
| 5,833,845 | A * | 11/1998 | Anderson | E04H 4/065 | 210/167.19 |
| 5,935,450 | A * | 8/1999 | Benedict | E04H 4/1272 | 210/167.19 |
| 6,214,217 | B1 * | 4/2001 | Sliger, Jr. | B01D 29/01 | 210/167.19 |
| 7,594,997 | B1 * | 9/2009 | Kazarian | E04H 4/1254 | 210/167.19 |
| 2002/0027097 | A1 * | 3/2002 | Baer | E04H 4/1254 | 210/167.19 |
| 2015/0053599 | A1 * | 2/2015 | Adam | E04H 4/1254 | 210/167.19 |

* cited by examiner

*Primary Examiner* — Fred Prince
(74) *Attorney, Agent, or Firm* — Braxton Perrone, PLLC

(57) ABSTRACT

A swimming pool or spa filtration system debris guard for preventing debris on the water surface from entering the opening of the filtration system. The debris guard having a screen and a detachable net assembly positioned substantially perpendicularly to the screen for collection of debris, with a spring activated post to secure the screen within or in front of a swimming pool skimmer opening.

16 Claims, 8 Drawing Sheets

SWIMMING POOL FILTRATIONS SYSTEM DEBRIS GUARD

This application claims priority to co-pending U.S. application Ser. No. 14/977,563 filed Dec. 21, 2015, which claims the benefit of priority to U.S. Provisional Patent Application No. 62/095,186 filed Dec. 22, 2014, which are incorporated herein by reference.

TECHNICAL FIELD

This disclosure relates generally to an apparatus that prevents debris from entering a swimming pool or spa filtration systems and in particular a debris diverter and collection apparatus that allows collection of debris from a swimming pool or spa surface while facilitating continued water flow to the filtration system.

DESCRIPTION OF THE RELATED ART

Swimming pool owners and operators are faced with the task of preventing leaves, litter, bugs, mulch or other debris from entering the swimming pool filtration system. Proper operation of a swimming pool filtration system requires largely uninterrupted flow of water into the filtration system. Pool water typically enters the filtration system through one or more skimmer devices installed along the interior surface of the swimming pool at water surface level. The skimmer is usually equipped with a basket that collects debris that is on the water surface. The pool's water filtration system typically causes water in the pool to circulate. At the surface, the water flows in a circular direction about the inner circumference of the swimming pool. As debris on the surface passes a skimmer device, the filtration system draws in the water and associated debris into the skimmer opening. The debris is caught in a basket inserted in the skimmer device, while the pool water passes through the basket and travels through pipes to what is usually a remote filter canister where the water is filtered and returned to the pool via various fixtures, such as jets.

In order for the filtration system to operate properly, the skimmer basket must be kept relatively free from debris. This means that the pool owner or operator must regularly check and empty the skimmer baskets. Even a relatively small number of leaves or other debris caught in the skimmer basket can disrupt water flow to the filter, causing less than optimal water filtration and sanitizing and possible failure of the filter motor or pump or other associated equipment. Failure of filter equipment requires immediate repair or replacement at considerable expense.

The task of keeping skimmer baskets free from debris is a time consuming task, and excessively time consuming at various times of year. In autumn, it may be necessary to empty skimmer baskets several times a day to maintain proper filtration. With busy schedules of pool owners, it is unlikely that skimmer baskets will be emptied with the required frequency. What is needed is a device to prevent surface debris from entering the skimmer box while permitting continued water circulation and filtration and at the same time effectively collect the debris.

In order for the pool sweep system to operate properly, the pool sweep system must be cleaned and kept relatively free from debris. This means that the pool owner or operator must regularly check and empty the pool sweep device. Even a relatively small number of leaves or other debris caught in the pool sweep device can causing less than optimal cleaning and possible failure of the pool sweep device or other associated equipment. Failure of filter equipment requires immediate repair or replacement at considerable expense.

The task of cleaning and maintaining the pool sweep system is a time consuming task, and excessively time consuming at various times of year. In autumn, it may be necessary to empty the pool sweep device several times a day to maintain proper cleaning. With busy schedules of pool owners, it is unlikely that pool sweep device will be emptied with the required frequency. What is needed is a device to prevent surface debris from falling to the bottom of the pool to be collected by the pool sweep device while permitting continued water circulation and filtration and at the same time effectively collect the debris.

Efficient and effective removal of leaves and other debris is essential for proper pool chemistry. Pool water chemistry is fundamental to maintaining safe and consistent swimming pool operation. Leaves and other debris can affect water balance, consume chemicals, and can stain pool surfaces.

The task of maintaining proper pool chemistry is an expensive and time consuming task, and excessively time consuming at various times of year. If leaves and other debris are not removed from the pool in a timely manner, it may be necessary to check pool chemistry frequently to maintain proper water balance. With busy schedules of pool owners, it is unlikely that pool water will be maintained at proper levels. What is needed is a device to allow the efficient and effective removal of leaves and other debris to assist in maintaining proper pool chemistry.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings and photographs, wherein:

DETAILED DESCRIPTION OF THE EMBODIMENTS

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

The detailed description set forth below is intended as a description of the presently embodiments of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the figures, which are provided for purposes of illustrating an embodiment of the present invention only, and not for purposes of limiting the same, there is shown a water surface debris guard specifically configured and adapted to prevent large and small debris floating on the surface of the water from entering the pool skimmer. The debris guard is placed in the pool such that the debris guard forms a protective water surface debris barrier around the skimmer opening. Therefore, leaves, bugs, grass, litter, and other items floating near the surface of the pool may be blocked by the debris guard and prevented from entering the skimmer to allow the water circulation cycle to continue. In this regard, the debris may gather or collect at the outside of the debris guard in a manner which may not impede the flow path of water from the pool to the skimmer.

Figure 1:
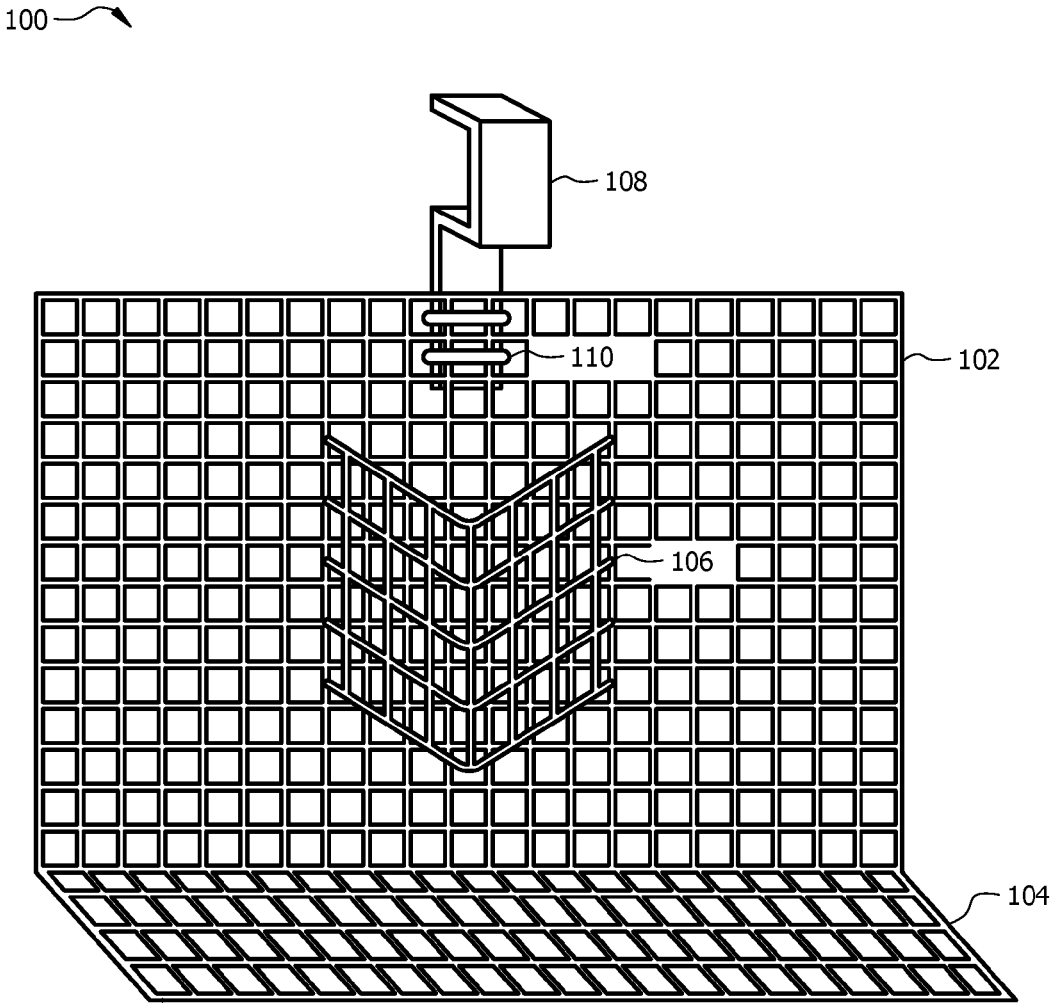
FIG. 1 depicts a perspective view of an embodiment of the present swimming pool debris guard.

In FIG. 1, an embodiment of swimming pool debris guard 100 is depicted. Debris guard 100 includes a vertically positioned screen 102 and an adjacent substantially horizontally positioned collector 104 situated at an acute angle from screen 102. Screen 102 and collector tray 104 are constructed of a mesh-like material to permit water flow to the pool filtration system. The mesh-like material may be constructed of metal (with or without coating to inhibit rust), plastic or any other suitable material.

Attached at an approximate central area of screen 102 is diverter 106. Diverter 106 in one embodiment is a substantially v-shaped structure positioned vertically and affixed to screen 102 as shown. Situated at an upper portion of screen 102 is connector 108. In one embodiment, connector 108 is a u-shaped clamp configured to slide over an associated section of pool edging or decking as will be discussed. Connector 108 secures debris guard 100 at a position in front of a pool skimmer to prevent debris from entering pool filtration equipment. In one embodiment, 108 is an adjustable tension connector that secures the debris guard to the pool deck surface and allows for the installation of the debris guard on surfaces of varying thickness. Other clamping devices are contemplated to secure the debris guard to an associated pool decking surface. The debris guard also includes height adjuster 110 for adjusting the position of debris collector 100 to accommodate pool skimmer equipment location in relation to pool decking. The distance between a pool skimmer opening and pool decking is not uniform. As such, the height adjuster 110 allows for connector 108 to be raised or lowered in relation to screen 102 to effectively lower or raise the location of debris guard 100. In one embodiment, height adjuster 110 comprises one or more staple-type devices that may be opened and tightened around the lower portion or connector 108 once a desired location of screen 102 in relation to the pool skimmer is achieved. Other embodiments, such as a telescoping device, a sleeve or an extension arm are contemplated to promote the adjustability of connector 108.

Figure 2:
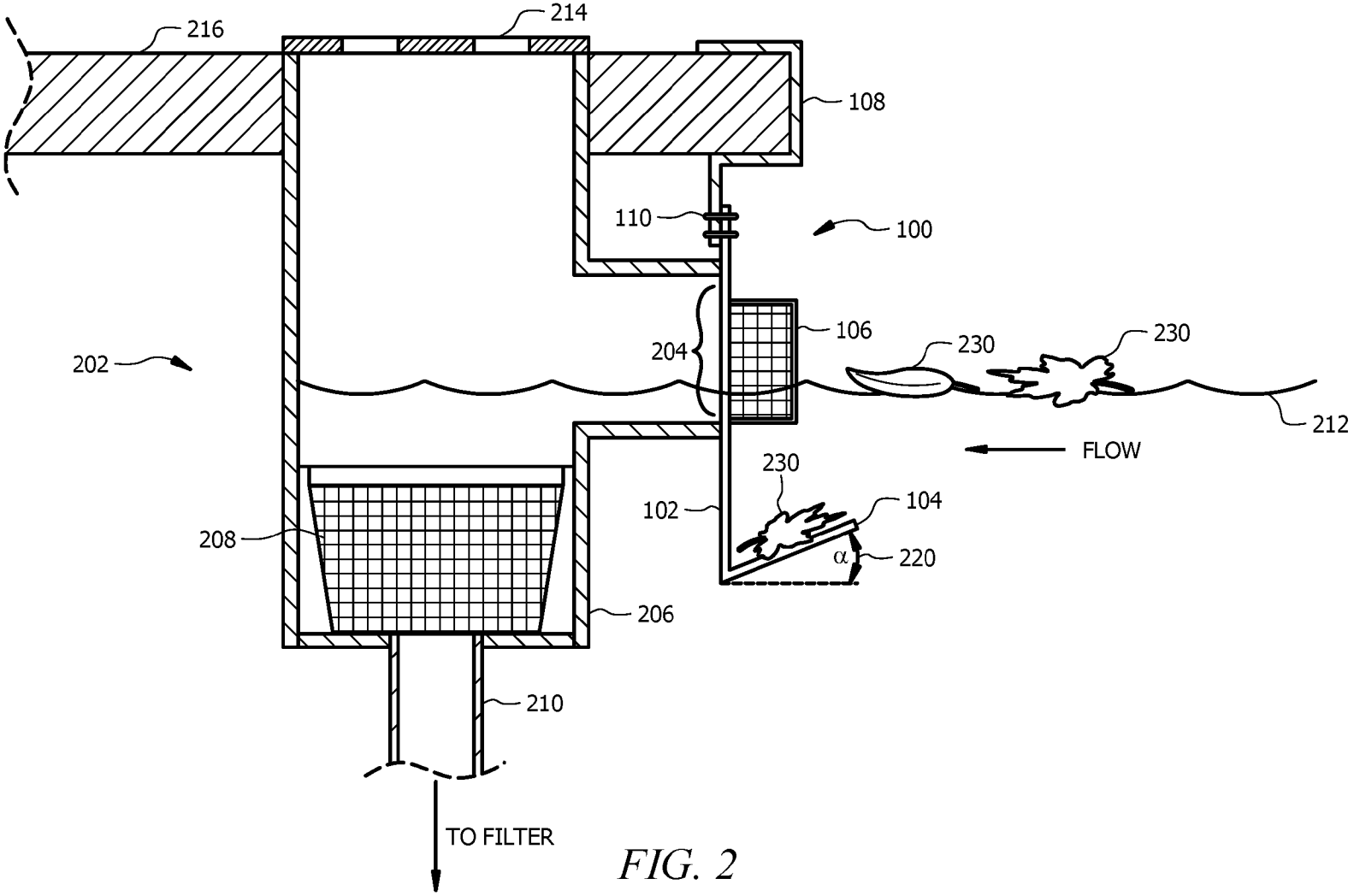
FIG. 2 is a side view of an embodiment of the present swimming pool debris guard and associated pool skimmer.

The positioning and operation of debris guard 100 is made by reference to FIG. 2. FIG. 2 is a diagram of debris guard 100 positioned in front of a pool skimmer configuration 202. Pool skimmer 202 includes opening 204. Opening 204 is the interface between pool skimmer 202 and the pool swimming area. Pool skimmer is intended as one of perhaps several avenues for pool water to enter a remote pool filtration system. Opening 204 is positioned in relation to a pool decking surface 216 to dictate the desired height of water surface 212.

In operation, pool water flows into skimmer 202 through opening 204 and passes through basket 206 located in basket container 208, and through at least one pipe 210 and ultimately to a remote pool filter. The purpose of skimmer 202 is to promote water circulation and filtration. Basket 206 serves to prevent debris from entering pipe 210 and entering the remote pool filter. Basket 206 is constructed of a mesh-like material, typically plastic, to allow water to pass through it and ultimately to the filter while catching debris. A skimmer cover 214 covers an opening in decking surface 216 to allow access to skimmer 202 and in particular basket 206 to allow convenient removal of debris from basket 206.

Without debris guard 100, debris 230 located on water surface 212 will travel with water from the pool into skimmer 202. Debris 230 is collected by basket 206 to prevent entry into pipe 210 and ultimate entry into remote pool filter equipment. Over time, a large amount of debris will collect in filter basket 206. If basket 206 is largely full of debris, water flow to the filter is significantly impeded or prevented altogether. This causes failure of effective water circulation and filtration and ultimately failure of pool filtration equipment.

The placement of debris guard 100 as shown in FIG. 2 greatly prevents entry of surface debris 230 into skimmer 202. As shown, debris guard 100 is attached to pool decking 216 by connector 108. As shown, connector 108 securely grips associated decking 216. The desired height of screen 102 and diverter 106 is achieved by proper positioning of height adjuster 110. As shown, debris guard 100 is positioned where screen 102 covers skimmer opening 204 and diverter 106 is located substantially at a position where diverter is partially submerged in the pool water. This positioning promotes effective diverting of debris from screen 102 and opening 204. In operation, diverter 106 acts to divert debris away from screen 102. Over time, as debris is prevented from entering skimmer 202 by screen 102, without diverter 106 the leaves or debris will collect on the face of screen 102 and water flow into skimmer 202 will be impeded. Diverter 106, with its substantially triangular shape, causes leaves coming into proximity of debris guard to travel away to the left or the right from opening 204.

Figure 3:
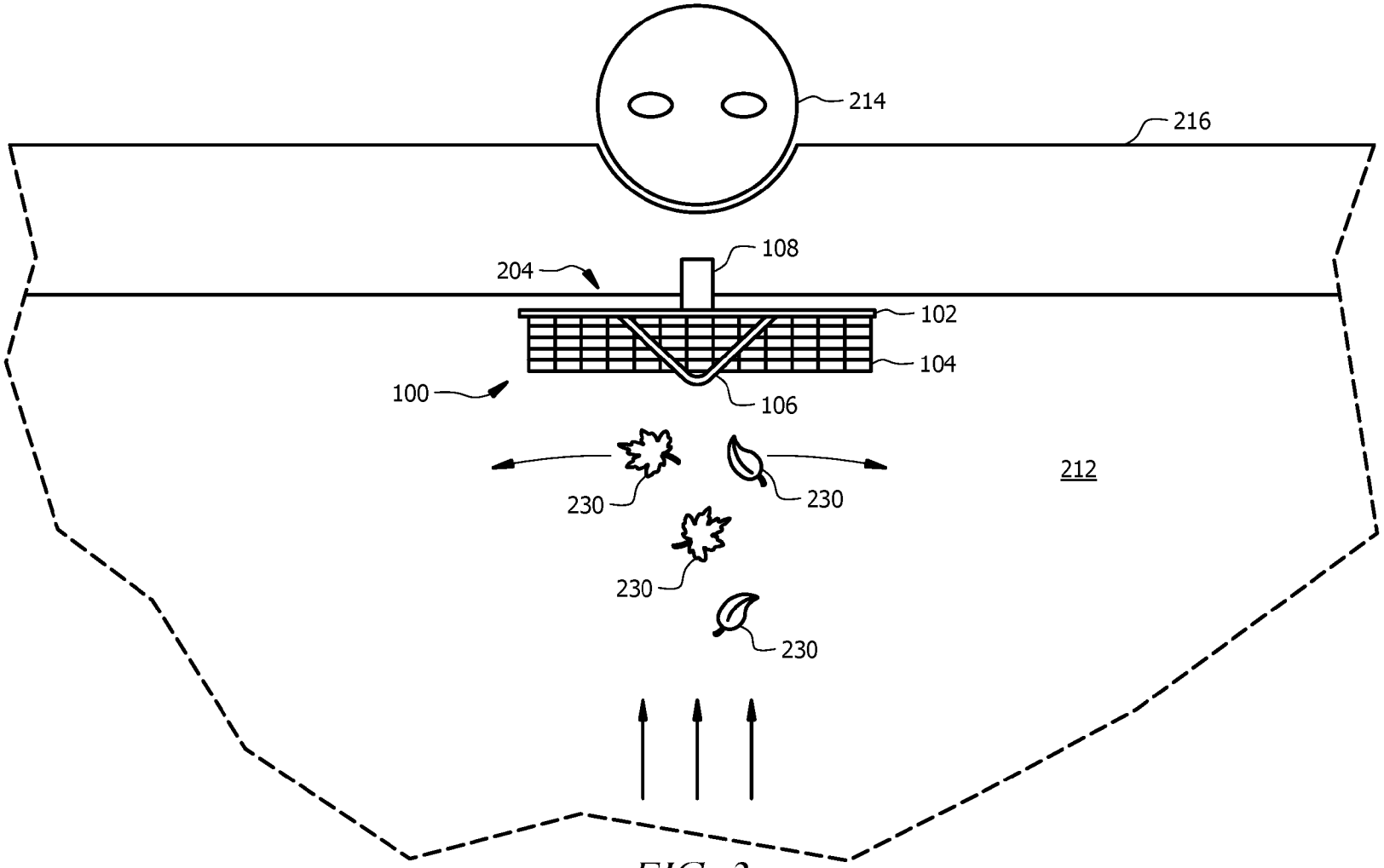
FIG. 3 is an aerial view of an embodiment of the present swimming pool debris guard as installed.

FIG. 3 depicts an aerial view of debris guard 100 installed at skimmer opening 204 by attachment of connector 108 to pool decking 216. As shown, debris 230 on water surface 212 flows toward skimmer opening 204. As water passes towards opening 204, debris 230 travels in that direction as well. As water passes through screen 102 and into skimmer 202, debris 230 is prevented from entering skimmer 202 by screen 102. At the same time, as debris 230 comes into proximity of diverter 106, debris 230 is pushed away from diverter 106 to one side or another, thus staying clear of screen 102. This allows water to continue to enter skimmer opening 204.

Referring back to FIG. 2, while some debris 230 may collect near the face of screen 102, over time the debris will become waterlogged and tend to sink beneath water surface 212. The junction of collector tray 104 and screen 102 form an acute angle "a" 220. Collector tray 104 and screen 102 are situated in this fashion to promote the collection of debris 230 in the area formed at the junction point of screen 102 and collector tray 104. In this manner, some of the debris 230 blocked by screen 102 will eventually sink and be caught by collector tray 104 rather than sinking to the bottom of the swimming pool. Thus, instead of unwanted debris entering basket 208 that may possible cause filtration failure, the unwanted debris is collected by tray. At that point, the pool operator may remove debris guard 100 from pool decking 216 and remove 230 from collector tray 104 and elsewhere on the face of screen 102 or diverter 106. Even if collector tray 104 is not emptied for some time, excess debris may simply fall to the pool bottom which will not cause pool filtration performance downgrade or damage.

The debris guard may be selectively placed in the pool as desired by the user. Along these lines, the debris guard may be employed when the pool owner will be absent for a period of time, or during a time of year which is more likely to produce debris in the pool. For instance, leaves tend to fall from trees during the fall season, and therefore, it may be advantageous to employ the debris guard if the pool is located near one or more trees. Debris may also be more likely to gather in a pool during a windy season. Although the foregoing describes environments including trees and wind, those skilled in the art will appreciate that the present invention is not limited thereto, and that foregoing illustrations are exemplary in nature only and not intended to limit the scope of the present invention.

The debris guard includes a deflector or diverter in the middle of the debris guard screen to divert debris to the sides of the debris guard and allow for continuous water circulation.

The debris guard includes a collector tray to capture debris that would otherwise fall to the bottom of the pool. The collector tray also allows for easy removal of debris.

Figure 4:
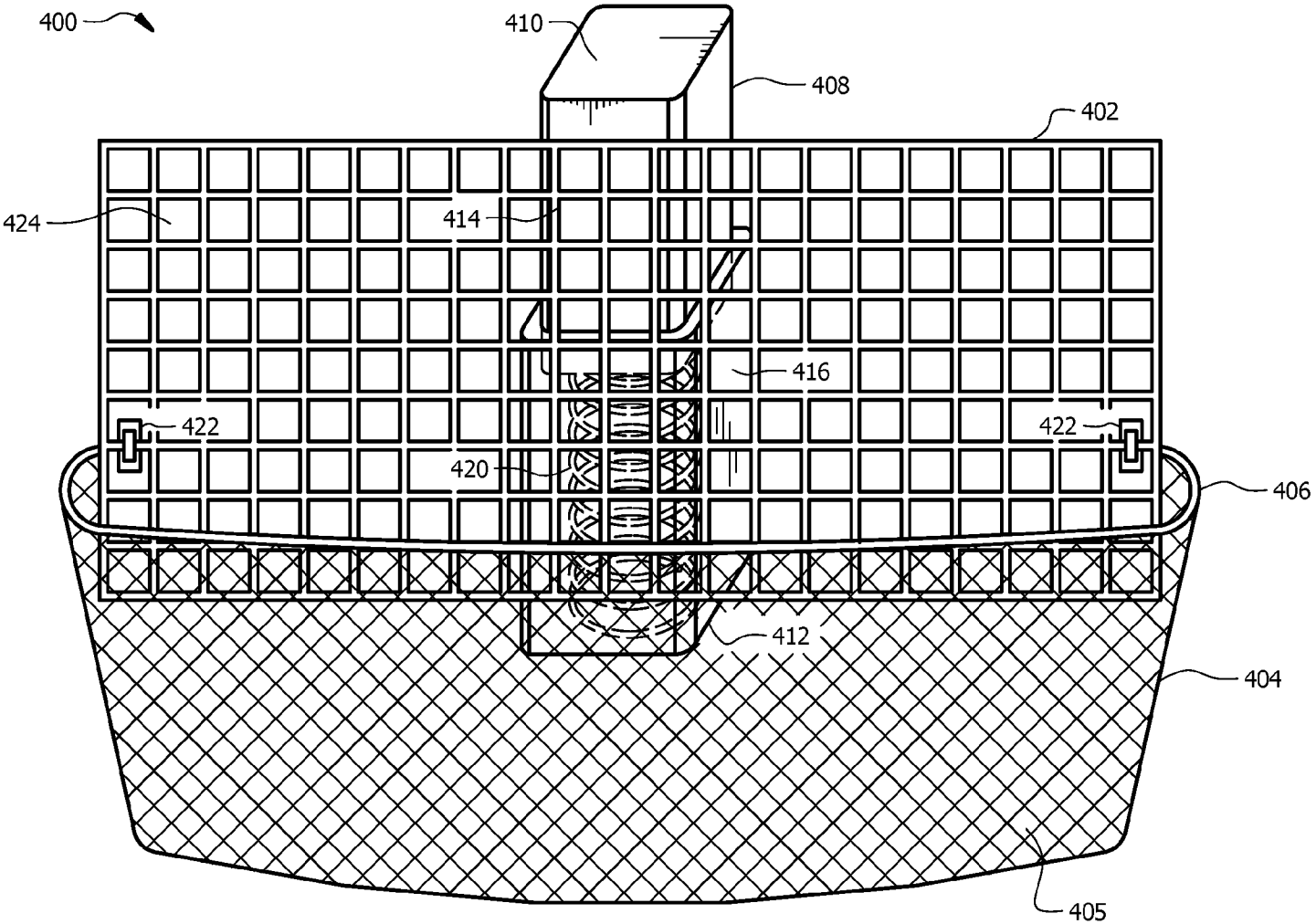
FIG. 4 is a perspective view of an embodiment of the present swimming debris guard.

An alternative embodiment of the presently disclosed swimming pool debris guard is depicted in FIG. 4. In FIG. 4 debris guard 400 that is to be installed at a swimming pool skimmer opening formed in the vertical interior wall(s) of the swimming pool. Through the swimming pool opening, water enters the pool filtration system by first passing through a skimmer basket as is customary in virtually all swimming pools. It is important for pool filtration equipment and the skimmer basket to be kept free of leaves, pool toys and debris to prevent filtration system damage for lack of water flow and to promote effective operation of the system. Accordingly, regular emptying and maintenance of pool skimmer baskets is required. In pools placed in heavily treed areas, leaves on the pool's surface is a serious problem requiring constant attention.

In FIG. 4, debris guard 400 includes screen 402 arranged in a substantially vertical position. Attached at a lower portion of screen 402 is a net 404 arranged supported by hoop 406. Hoop 406, which serves as a frame for net 404, is removably attached to screen 402 and is arranged in a substantially perpendicular position to screen 402. Net 404 is made of a mesh material having openings 405 therein that are sufficiently large to allow water to drain from net 404 upon its removal from screen 402 yet sufficiently small to prevent leaves and debris to escape once inside of net 402. In one embodiment, openings 405 are between one (1) mm and one (1) cm in width. Other sizing of openings 405 may be suitable depending on the environment of the swimming pool.

Net 404 is arranged at a lower portion of screen 402 to catch debris that gathers at the screen 402 rather than allow the debris to fall to the bottom of the pool. Net 404 and hoop 406 arrangement is detachably connected to screen 402 via clips 422 disposed on opposite ends of hoop 406. In this manner, the user may easily empty leaves and debris from net 404 by disconnecting hoop 406 with associated net 404 from screen 402 without disengaging the entire debris guard from the skimmer opening. Once emptied, net 404 is easily reattached onto screen 402 by engaging clips 422. In an alternative embodiment, hoop 406 is permanently affixed to screen 402.

For user safety, hoop 406 may be constructed of material such as PVC, plastic, or rubber and may be covered with a foam layer to prevent injury to nearby swimmers. Screen 402 may be constructed of plastic or metal mesh material having openings 424 sufficient to allow water to pass through the screen but prevent debris from passing through. In one embodiment, openings 424 in screen 402 are between one (1) mm and two (2) cm in width. Other sizing of openings 424 may be suitable depending on the environment of the swimming pool. The overall size of screen 402 conforms substantially to the size of skimmer opening 204 (FIG. 3) in swimming pools, which may be twenty inches in width and twelve inches in height or made in any suitable size to fit the dimensions of a particular skimmer opening, whether for use in a swimming pool or a spa.

Continuing with FIG. 4 spring tension post 408 is attached in a vertical position at substantially the center of screen 402. In one embodiment, spring tension post 408 includes an upper end 410 that when installed comes into contact with the upper side of the skimmer opening and a lower end 412 that when installed comes into contact with the lower side of the skimmer opening. Spring tension post 408 includes a plunger 414 and a sleeve 416 for slidably receiving plunger 414. Within sleeve 416 and attached to either the underside of plunger 414 or the interior base of sleeve 416, or both, is spring 420, shown in dashed lines. Debris guard 100 is secured in place within or at the front of the skimmer opening with spring tension post 408. To accommodate skimmer openings of various heights, spring 420 disposed between plunger 414 and sleeve 416 enables contraction of the overall height of spring tension post 408 to permit insertion within the skimmer opening. Once lower end 412 and upper end 410 of spring tension post 408 are positioned where screen 402 is in the desired location that adequately covers the skimmer opening to prevent debris on the surface from entering the skimmer opening, the installer of spring tension post may release plunger 414, allowing it to slide upward within sleeve 416. As a result, upper end 410 of spring tension post 408 comes into firm contact with the upper interior surface of the skimmer opening, securing debris guard 400 in place. Plunger 414 and sleeve 416 of spring tension post 408 may be constructed of plastic, metal or any other suitable material.

Although as shown in FIG. 4 one spring tension post 408 is situated vertically at the relative midpoint of screen 402, other arrangements are contemplated and suitable. In one embodiment, two or more spring tension posts 408 may be spaced across screen 402, depending upon the size of screen 402 and the corresponding skimmer opening. Similarly, one or more spring tension post 408 may be arranged horizontally in relation to screen 402 rather than vertically, with the upper end 408 and lower end 412 coming into contact with the left and right interior walls of the skimmer opening (rather than the upper and lower) in order to secure debris guard 400 in the desired position.

Note that as shown in FIG. 4, debris guard 400 does not include a diverter 106 disposed on screen 402 as described with respect to screen 102 in FIG. 1. A diverter such as that shown in FIG. 1, however, may optionally be placed on screen 402 to provide additional means to divert debris away from the skimmer opening.

Figure 5:
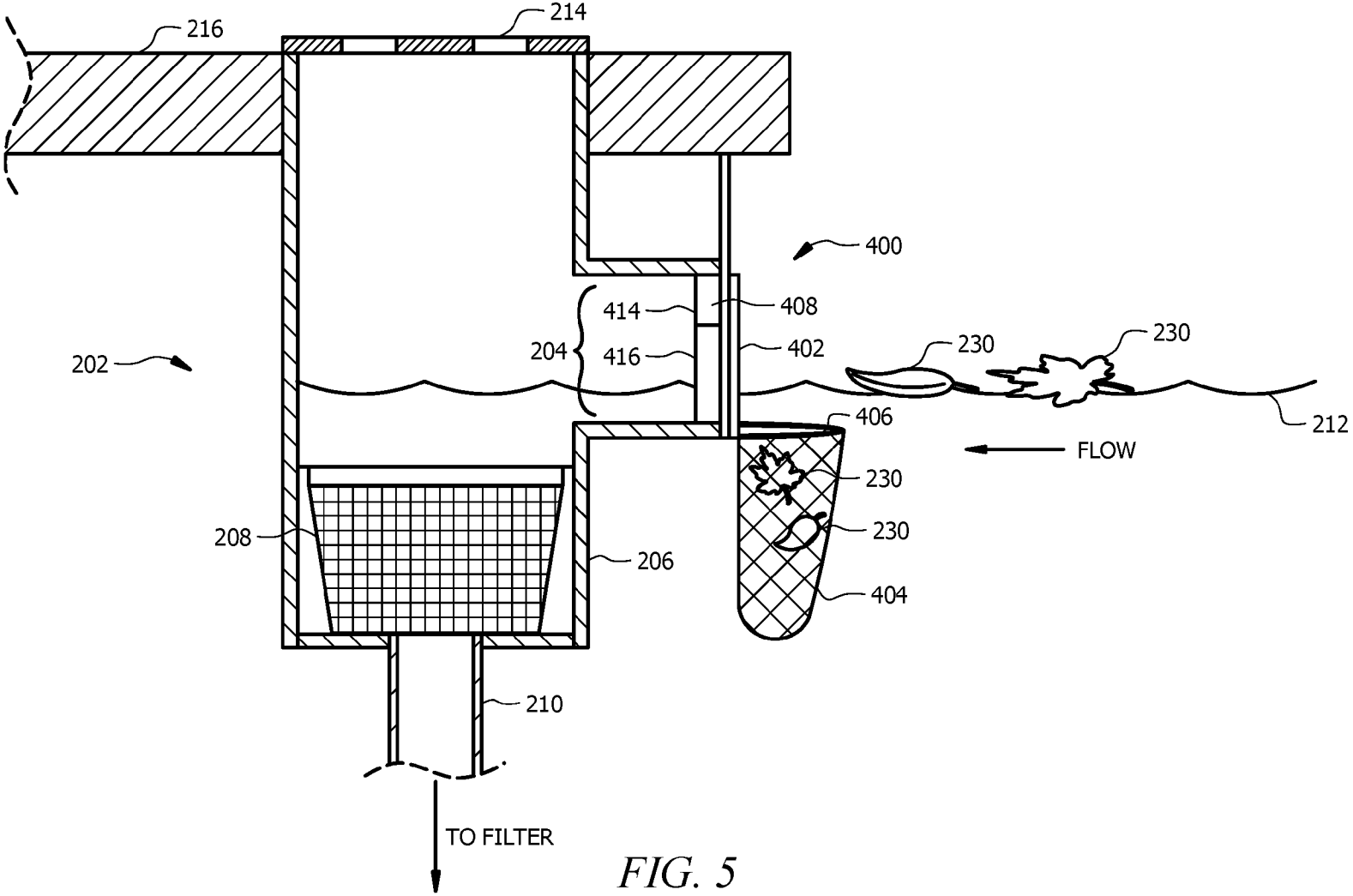
FIG. 5 is a side view of an embodiment of the present swimming pool debris guard and associated pool skimmer.

The positioning and operation of debris guard 400 is made by reference to FIG. 5. FIG. 5 is a diagram of debris guard 400 positioned in front of a pool skimmer configuration 202. Pool skimmer 202 includes opening 204. Opening 204 is the interface between pool skimmer 202 and the pool swimming area. Pool skimmer is intended as one of perhaps several avenues for pool water to enter a remote pool filtration system. Opening 204 is positioned in relation to a pool decking surface 216 to dictate the desired height of water surface 212.

In operation, pool water flows into skimmer 202 through opening 204 and passes through basket 206 located in basket container 208, and through at least one pipe 210 and ultimately to a remote pool filter. The purpose of skimmer 202 is to promote water circulation and filtration. Basket 206 serves to prevent debris from entering pipe 210 and entering the remote pool filter. Basket 206 is constructed of a mesh-like material, typically plastic, to allow water to pass through it and ultimately to the filter while catching debris. A skimmer cover 214 covers an opening in decking surface 216 to allow access to skimmer 202 and in particular basket 206 to allow convenient removal of debris from basket 206.

Without debris guard 400, debris 230 located on water surface 212 will travel with water from the pool into skimmer 202. Without the presently described debris guard 400, debris 230 will be collected by basket 206 to prevent entry into pipe 210 and ultimate entry into remote pool filter equipment. Over time, a large amount of debris will collect in filter basket 206. If basket 206 is largely full of debris, water flow to the filter is significantly impeded or prevented altogether. This causes failure of effective water circulation and filtration and ultimately failure of pool filtration equipment.

The placement of debris guard 400 as shown in FIG. 5 greatly prevents entry of surface debris 230 into skimmer 202. As shown, debris guard 400 is attached at the interior of skimmer opening 204 with spring tension post 408 disposed on the back of screen 402. As shown, spring tension post 408 firmly fits into skimmer opening 204 through spring action of the internal spring 420 that causes the plunger 414 and 416 to adjust in height, as previously described. As shown, debris guard 400 is positioned where screen 402 covers skimmer opening 204. This positioning promotes effective prevention of debris 230 from passing through opening 204. Once debris 230 gathers at screen 402, it will drop into net 404 positioned at a lower section of screen 402 and aligned beneath skimmer opening 204. The user may easily detach net 404 and hoop 406 by releasing clips 422 to empty debris 230 from net 404.

Figure 6A:
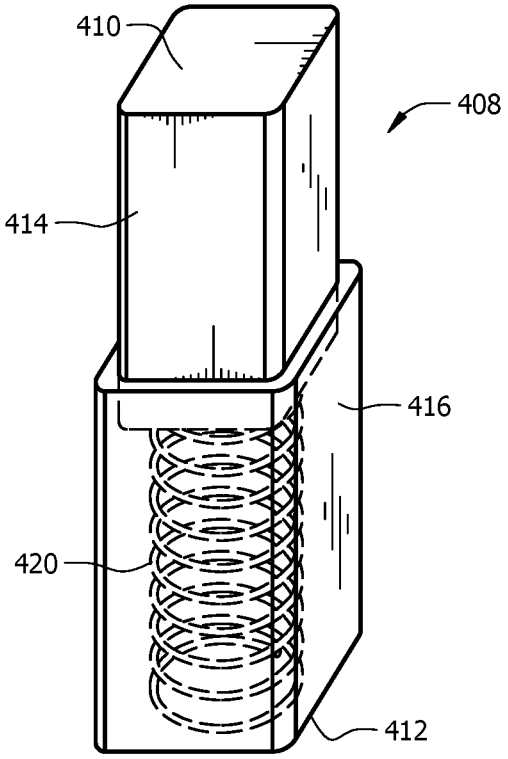
FIG. 6A is a perspective view of an embodiment of a securing mechanism of the present swimming pool debris guard.
Figure 6B:
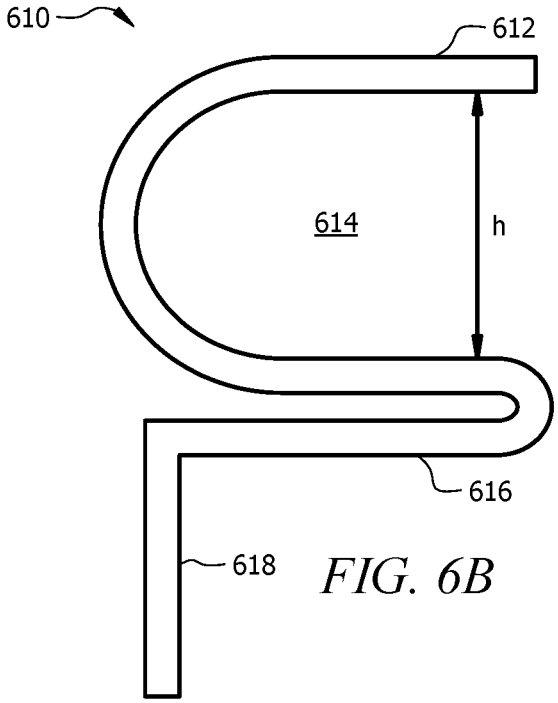
FIG. 6B is a perspective view of an embodiment of a securing mechanism of the present swimming pool debris guard.
Figure 6C:
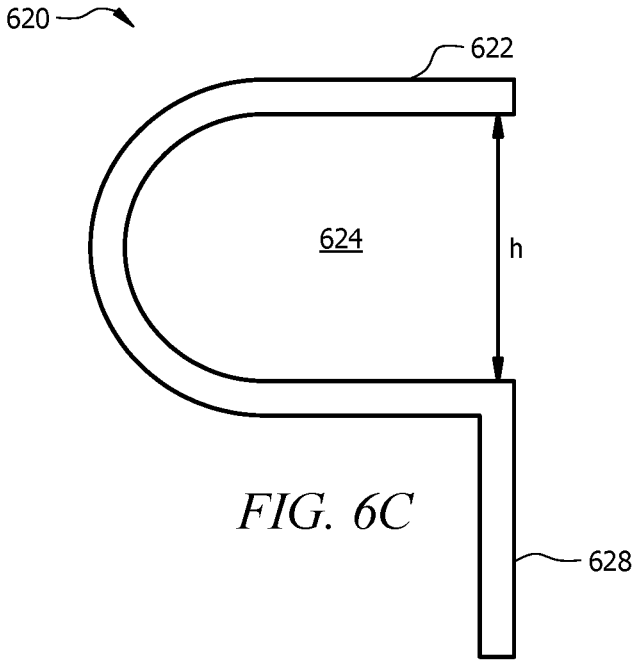
FIG. 6C is a perspective view of an embodiment of a securing mechanism of the present swimming pool debris guard.

FIGS. 6A, 6B and 6C depict alternative posts to secure debris guard 100 of 400 in front of or within the skimmer opening. Spring tension post 408 previously described in reference to FIG. 4 is depicted in FIG. 6A and includes an upper end 410 and lower end 412. Upper end 410 and lower end 412 come into contact with interior upper and lower sides of a skimmer opening to secure debris guard 400 into place. The upper half of spring tension post 408 is a plunger 414 that slidably engages within sleeve 416. In FIG. 6A, the lower front portion of sleeve 416 is cut away to show the interior spring 420 that is connected to the lower side of plunger 414, the bottom interior of sleeve 416, or both. Spring 420 provides the expandability and contractibility of spring tension post 408 to achieve an adjustable height enabling positioning of screen 402 in front of or within skimmer openings of various heights and widths.

FIG. 6B depicts another embodiment of a post for mounting debris guard 400 or 100. Tension clip 610 in FIG. 6B includes a generally c-shaped clip section 612. C-shaped clip section may be attached to pool decking 216 shown in FIG. 5 by sliding the opening 614 formed by c-shaped clip onto the edge of pool decking 216. Clip section 612 is formed of metal or plastic and with sufficient flexibility to permit use on decking of various thickness and tension to enable adjustment of a height h of opening 614. The flexibility and tension of c-shaped clip section 612 allows easy installation and removability of debris guard 400 and maintains the strength to hold debris guard in the desired position in front of the skimmer opening after repeated use. Tension clip 610 may include folded base section 616 affixed at one end of c-shaped clip section 612 and at the other to vertical shaft 618 to provide additional strength where a larger debris guard 400 is needed for larger pool skimmer openings. Vertical shaft 618 is fastened to screen 402 through any suitable fastening technique known in the art. Vertical shaft 618 may be made of telescoping sections that serve to adjust the length of vertical shaft 618 to accommodate the distance between pool decking 216 and skimmer opening 204. Other methods known in the art may be employed for adjustment of the length of vertical shaft 618. Alternatively, screen 402 and tension clip 610 may be singularly formed by various processes, including injection molding.

Another embodiment of the tension clip serving as a mounting post is provided in FIG. 6C. In FIG. 6C, tension clip 620, like clip 610, includes a c-shaped clip section 622 forming an opening 624 that allows clip 620 to be inserted on an edge of pool decking 216. The flexible construction of c-shaped clip section 622 allows the opening 624 to achieve an adjustable height b of opening 614. In this manner, clip 620 may be inserted onto pool decking of various thickness and maintain its elasticity after repeated use. In this embodiment, tension clip 620 has attached vertical bar 628 directly at a lower end of c-shaped clip section 622. Vertical bar 628 is fastened to screen 402 through any suitable fastening technique known in the art. Alternatively, screen 402 and tension clip 620 may be singularly formed by various processes, including injection molding.

Figure 7:
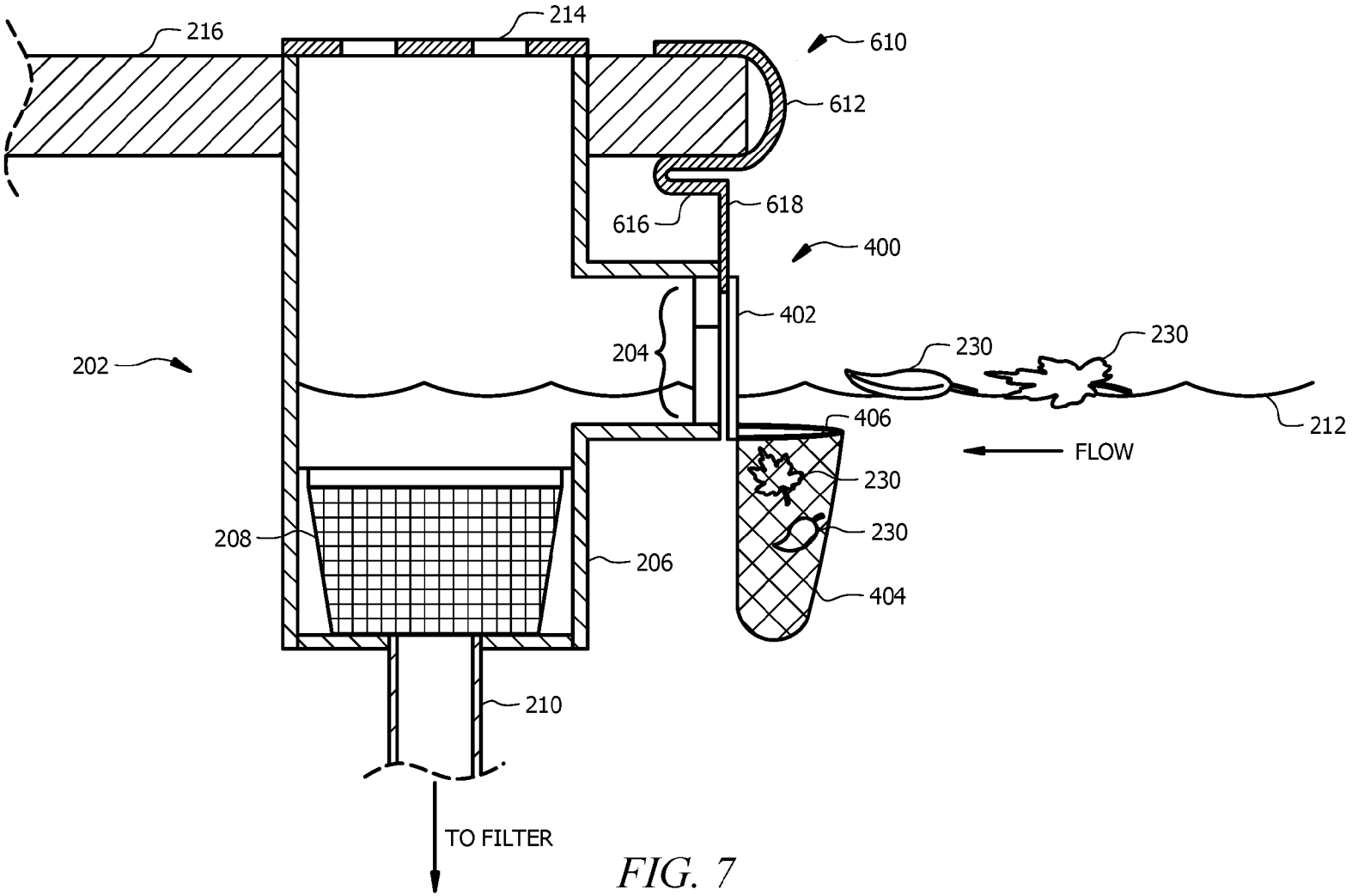
FIG. 7 is a side view of an embodiment of the present swimming pool debris guard and associated pool skimmer.

FIG. 7 depicts an embodiment of the presently described debris guard in which debris guard 400 is mounted in front of skimmer opening 204 and is secured in place with tension clip 610. As shown, c-shaped clip section 612 receives the edge of pool decking 216. The tension action or elasticity of c-shaped clip section 612 allows a tight fit on the edge of pool decking 216. Vertical bar 618 is connected to screen 402 and folded base section 616 provides added strength at the underside of pool decking 216. The remaining components of FIG. 7 are similar to FIG. 5 except spring tension post 408 is removed as it is no longer needed with tension clip 410 serving as the attachment mechanism for debris guard 400 in this embodiment. In FIG. 7, basic tension clip 620 of FIG. 6C may replace tension clip 610 and similarly hold debris guard 400 in place.

The presently described debris guard may be formed from materials that are well known including, plastic, nylon, rubber, wire, metal, plastic tubing, netting, metal tubing, mesh material, and other materials capable of being disposed in chlorinated water or salt water for extended periods of time.

Debris guard may be formed of plastic, nylon, rubber, wire, metal, plastic tubing, netting, or mesh material that is tied or bound to the frame to extend over the central opening defined by the frame. The described hoop and net assembly may be secured to the screen by mechanical fasteners, such as snaps, buttons, rivets, clips or other fasteners known by those skilled in the art. Similarly, the described collection tray and diverter may be secured to the screen by mechanical fasteners, such as snaps, buttons, rivets, clips or other fasteners known by those skilled in the art. In this regard, it may be advantageous for the components of the presently described debris guard to be flexible, as well as selectively removable from the frame to facilitate removal and cleaning. In an alternative embodiment, debris guard and its components may be of a single body construction or may be formed by known injection molding or other molding techniques.

The presently disclosed debris guard may include a removable smaller screen having a finer mesh that can be used to collect smaller debris, including small leaves, bugs, grass clippings, hair, flower petals and the like.

The disclosed debris guard includes an adjustable height mechanism to adjust the height of the screen in conjunction with the pool skimmer opening. The disclosed debris guard is also advantageously configured to allow water from the pool to easily flow to the skimmer through the skimmer opening. The configuration and placement of the debris guard within the pool does not substantially inhibit water flow into the skimmer opening. In this regard, the diverter allows water to flow to the skimmer opening.

In one embodiment, screen 102 and collector tray 104 are generally rectangular or oblong in shape. It is contemplated that other embodiments of the frame may define other shapes and configurations, such as a square, oval, triangle, circle or other shapes contemplated by those skilled in the art. In another embodiment, net 404 and hoop 406 arrangement may be rectangular or oval or of any suitable shape to achieve sufficient debris collection.

Debris guard may be also be secured to the pool wall with magnets. The magnetic fasteners may magnetically engage with complimentary magnetic fasteners or to magnetic tabs that would be affixed to the side of the pool.

The presently described debris guard system may be constructed of materials having flexibility properties to allow for safety and ease of care of debris guard and may have a foam or other protective material surrounding the perimeter of the various components, such as rubber or foam padding.

The system provides an easy-to-use solution for reducing the amount of debris which passes into the skimmer. In this regard, the water circulation and filtration system may operate at relatively normal levels without the debris blocking water circulation. In addition, after the debris guard has been placed in the pool for a period of time, the debris may gather near the debris guard, which may facilitate removal of the debris from the water. In other words, rather than having to skim the entire surface of the pool, a large percentage of the debris may be directed toward the debris guard. Thus, the user may skim the water adjacent the debris guard to quickly remove a large percentage of the debris.

The debris guard system described herein may also be quickly and easily placed in the pool when needed. Therefore, if a pool owner is going on vacation, the user may place the debris guard in the pool to prevent debris from passing into the skimmer. Also, if the pool owner is aware of a storm that is forecast in the area, the pool owner may place the debris guard in the pool to protect the skimmer from debris that may fall in the pool. After the pool owner returns home, or the storm passes, the debris guard may be easily removed from the pool to allow the pool owner to enjoy the pool without the debris guard presenting an obstruction.

Additional modifications or enhancements of the present invention may also be apparent to those of ordinary skill in the art. Thus, the particular combination of components described and figures herein are intended to represent only certain embodiments of the present invention, and are not intended to serve as limitations of alternative debris guards and methods within the spirit and scope of the invention.

I claim:

1. A swimming pool maintenance system for reducing entry of debris into a swimming pool filtration system, comprising:

a vertical screen having a height and a width for at least partially covering a skimmer opening of a swimming pool water filtration system;

a debris collector connected substantially perpendicularly to the vertical screen; and at least one adjustable securing post associated with the vertical screen for securing the vertical screen at the skimmer opening, wherein the adjustable securing post further comprises a first body half slidably engaged with a second body half.

2. The system of claim 1, further comprising a spring enclosed within the adjustable securing post for compression and release of the first body half and the second body half.

3. The system of claim 1, wherein the debris collector is detachably connected to the vertical screen.

4. The system of claim 1, wherein the debris collector further comprises a net supported by a frame.

5. The system of claim 4, wherein the frame is constructed of a material selected from a group consisting of plastic, nylon, rubber, wire, metal, plastic tubing, and metal tubing.

6. The system of claim 1, wherein the vertical screen is constructed of a material selected from a group consisting of plastic, nylon, rubber, wire, metal, plastic tubing, netting, metal tubing, and mesh material.

7. The system of claim 1, wherein the at least one adjustable securing post may be affixed to the vertical screen horizontally.

8. The system of claim 1, wherein the at least one adjustable securing post may be affixed to the vertical screen vertically.

9. A swimming pool maintenance system for reducing entry of debris into a swimming pool filtration system, comprising:

a vertical screen having a height and a width for at least partially covering a skimmer opening of a swimming pool water filtration system;

a debris collector connected substantially perpendicularly to the vertical screen; and a flexible securing clip associated with the vertical screen for insertion onto an edge of the swimming pool and securing the vertical screen at the skimmer opening, wherein the flexible securing clip further comprises a c-shaped clip in association with a shaft.

10. The system of claim 9, wherein the debris collector is detachably connected to the vertical screen.

11. The system of claim 9, wherein the debris collector further comprises a net supported by a frame.

12. The system of claim 11, wherein the frame is constructed of a material selected from a group consisting of plastic, nylon, rubber, wire, metal, plastic tubing, and metal tubing.

13. The system of claim 9, wherein the vertical screen is constructed of a material selected from a group consisting of plastic, nylon, rubber, wire, metal, plastic tubing, netting, metal tubing, and mesh material.

14. The system of claim 9 wherein the shaft is of a length adjustable to accommodate a distance between the edge of the swimming pool and the skimmer opening.

15. A swimming pool maintenance system for reducing entry of debris into a swimming pool filtration system, comprising:

a vertical screen having a height and a width for at least partially covering a skimmer opening of a swimming pool water filtration system;

a substantially horizontal collection shelf connected to the vertical screen;

a diverter extending from and connected to a central section of the vertical screen;

a connector associated with the vertical screen; and a height adjuster associated with the connector for aligning the screen with the skimmer opening, wherein the height adjuster aligns the screen in relation to the opening of the swimming pool water filtration system.

16. The system of claim 15, wherein the horizontal collection shelf is detachably connected to the vertical screen.

* * * * *